US006487389B2

(12) United States Patent
Jia et al.

(10) Patent No.: US 6,487,389 B2
(45) Date of Patent: Nov. 26, 2002

(54) REFRESHING A STICKY CLEANER FOR A FUSER

(75) Inventors: Nancy Y. Jia, Webster, NY (US); Gerald M. Fletcher, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 34 days.

(21) Appl. No.: 09/727,355

(22) Filed: Nov. 30, 2000

(65) Prior Publication Data

US 2002/0064406 A1 May 30, 2002

(51) Int. Cl.[7] ..... G03G 15/20; G03G 21/00
(52) U.S. Cl. ..... 399/327; 15/256.5; 399/71
(58) Field of Search ..... 399/327, 71, 349; 15/256.5, 256.51, 256.52

(56) References Cited

U.S. PATENT DOCUMENTS

| | | | | |
|---|---|---|---|---|
| 3,649,992 A | | 3/1972 | Thettu | 15/256.52 |
| 4,000,963 A | | 1/1977 | Thettu | 399/327 |
| 4,013,400 A | | 3/1977 | Thettu et al. | 399/327 |
| 4,607,947 A | | 8/1986 | Ensing et al. | 399/308 |
| 5,678,153 A | * | 10/1997 | Okamoto et al. | 399/327 |
| 5,768,672 A | * | 6/1998 | van Herpen et al. | 399/327 |
| 6,215,975 B1 | * | 4/2001 | Berkes et al. | 399/327 |
| 6,226,489 B1 | * | 5/2001 | Eelen et al. | 399/327 |
| 6,282,397 B1 | * | 8/2001 | Tanioka | 399/327 X |

FOREIGN PATENT DOCUMENTS

JP 10-055119 * 2/1998

* cited by examiner

*Primary Examiner*—Sophia S. Chen
(74) *Attorney, Agent, or Firm*—Perman & Green, LLP

(57) ABSTRACT

A method of refreshing a sticky cleaner used for cleaning a fuser member in an electrophotographic printer is disclosed. The method includes the steps of precoating the cleaner member with a low cost polymer toner material prior to a printing operation removing contaminants from the sticky surface of the cleaner member. A refreshed cleaning member prior to being used to clean a fuser in an electrophotographic printer in accordance with the features of the present invention includes a surface cleaning member having minimal contaminants thereon, and a coating of a plastic toner material that can become tacky at the operating cleaner temperatures.

16 Claims, 3 Drawing Sheets

FIG. 2
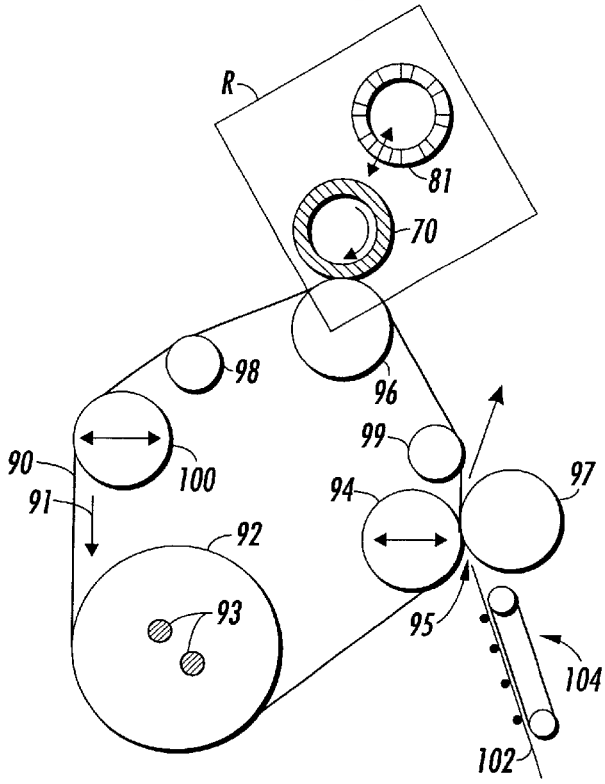
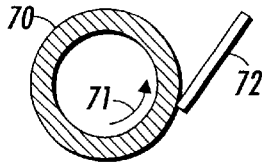
FIG. 3A
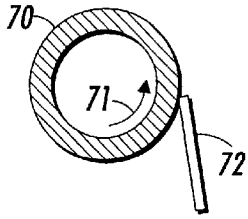
FIG. 3B

FIG. 4
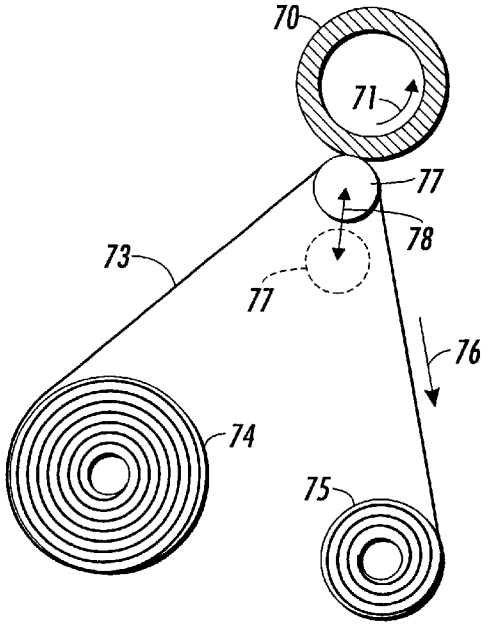
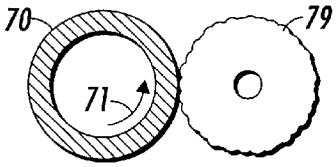
FIG. 5
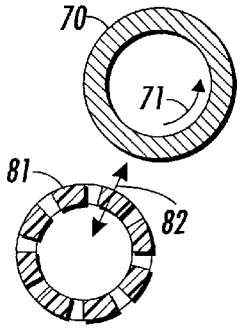
FIG. 6

REFRESHING A STICKY CLEANER FOR A FUSER

BACKGROUND OF THE INVENTION

1. Field of the Invention

This invention relates to cleaning systems for electrostatographic printing machines, and more particularly for cleaning systems for a fuser or transfuse apparatus as employed in these machines. Even more particularly this invention relates to a method for refreshing a cleaner roll used to clean a fuser or transfuse subsystem as employed in a electrophotographic printing machine.

2. Description of the Prior Art

Electrophotographic marking is a well known and commonly used method of copying or printing original documents. Electrophotographic is typically performed by exposing a light image of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after one or more intermediate transfer steps, onto a marking substrate such as a sheet of paper. The transferred toner powder image is then fused to the marking substrate using heat and/or pressure. The surface of the photoreceptor is then cleaned of residual developing material and recharged in preparation for the creation of another image.

The foregoing generally describes a typical black and white electrophotographic marking machine. Electrophotographic marking can also produce color images by basically repeating the above process once for each color that makes the color image. For example, the charged photoconductive surface may be exposed to a light image which represents a first color, say cyan. The resultant electrostatic latent image can then be developed with cyan toner particles to produce a cyan image which is subsequently transferred to a marking substrate. The foregoing process can then be repeated for a second color, say magenta, then a third color, say yellow, and finally a fourth color, say black. Beneficially each color toner image is transferred to the marking substrate in superimposed registration so as to produce the desired composite toner powder image on the marking substrate.

The color printing process described above superimposes the various color toner powder images directly onto a marking substrate. Another electrophotographic color printing process uses an intermediate transfer member. In systems which use an intermediate transfer member successive toner images are transferred in superimposed registration from the photoreceptor onto the intermediate transfer member. Only after the composite toner image is formed on the intermediate transfer member is that image transferred and fused onto the marking substrate.

The most common developing materials are dry powder toners. Dry powder developers are typically comprised of not only toner particles but also of carrier granules. The toner particles triboelectrically adhere to the carrier granules until the toner particles are attracted onto the latent image. An alternative to dry powder developing materials are liquid developers. Liquid developers, also referred to as liquid inks, have a liquid carrier into which toner particles are dispersed. When developing with liquid developers both the toner particles and the liquid carrier are advanced into contact with the electrostatic latent image. The liquid carrier is then removed by blotting, evaporation, or by some other means, leaving the toner particles behind.

Intermediate transfer members can also be used in the fusing process. Intermediate transfer members which are used in fusing are referred to herein as transfusing members, and the combined processes of transferring and fusing is called transfusing. Transfusing is highly desirable in high image quality electrophotographic printing. Transfusing members are usually pinched between one or more contact rollers and a backup roller such that a fusing pressure is created between the nip of the backup roller and the transfusing member. During fusing a marking substrate moves between the backup roller and the transfusing member and heat is applied to the toner image. The combination of heat and pressure causes the toner image to transfer and fuse onto the marking substrate. Transfusing may be done without heat, but the resulting quality is usually inferior.

As referred to above, electrostatic printers are known in which a toner image is fused or fixed to a substrate to form a final document. The fusing can occur after transfer of the toner image to the substrate, or transfer and fusing can simultaneously occur in a transfuse process. In either arrangement the substrate is fed into a fusing nip where a combination of fusing members, such as fusing or transfuse belts or rollers, apply heat and pressure to the toner image and substrate to fix or fuse the toner image to the substrate. During the fusing process, toner particles from the toner image, and debris from the substrate can adhere to the fusing member. These toner particles and other debris and contaminants can transfer from the fusing member to subsequent documents in the machine resulting in print defects. In addition, the build up of toner particles can also decrease the operational life of the fusing member. Therefore it is preferred to be able to clean the fusing members to remove toner particles and other particulate debris, such as dirt and fiber, that can affect final print quality.

One prior cleaner for a fuser such as described in U.S. Pat. No. 3,649,992 employs a cleaning roller engaging the surface of a fuser roll to remove toner particles. A toner layer initially applied to the roller surface becomes partially molten and tacky due to heating from the hot fuser surface, and additional toner particles, paper debris, and other contaminants on the fusing system preferentially adhere to the cleaner roller during the cleaning process. As excess toner particles accumulate on the cleaner roller, the toner layer on the surface of the cleaner roller can become uneven, resulting in uneven cleaning of the fusing member. Also, as excessive contaminants are trapped by the tacky toner layer due to for example long printing runs, tackiness of the toner layer can be reduced and cleaning function relative to further ability to trap contaminants can begin to degrade. These problems can be reduced by adding sufficient additional toner layers onto the tacky cleaner to "refresh" the surface and restore tackiness and thus allow additional cleaning of contaminants.

For "refreshing", a layer of toner can be periodically applied to the tacky cleaner surface in a variety of ways. For example, in a transfuse process a toner layer can be periodically developed and transferred to the transfusing member without engaging the final media substrate, and this refreshing layer of toner can then be made to adhesively transfer from the transfuse member to the tacky cleaner surface for refreshing the cleaner. Alternatively according to aspects of this patent application, for any type of fusing system toner layers can periodically be directly contact to, developed to, or transferred to the fusing member in a variety of other ways for refreshing the tacky cleaner via adhesive toner transfer to the cleaner from the fusing member. Further according to aspects of this patent application, toner layers can be more directly applied to the tacky member by various means such as by periodically engaging other surfaces to the tacky cleaner that have previously been covered with toner. For example, toner can be developed or otherwise previously applied to an additional roller or belt and the toner laden belt or roller can subsequently be engaged to the tacky cleaner member for refreshing the cleaner. Also, periodically, toner or like material can simply be substantially uniformly sprinkled onto the tacky cleaner.

These refreshing approaches can extend the ability of the tacky cleaner to clean contaminants for longer printing intervals. However, these approaches can not be continued indefinitely because eventually the toner layer on the cleaner roller can become excessively thick, and this can lead to back transfer to the fusing member of some fraction of the tacky toner layer, with resulting early failure of the cleaner. Thus a tacky cleaner requires maintenance to remove the excess toner in order to extend life and reliability of the cleaner.

In one alternative assembly (e.g. U.S. Pat. No. 4,607,947) the cleaner roller is formed of a hollow cylinder and apertures are provided in the cylinder to permit excess toner to be driven inward through the openings. Excess toner therefore is collected on the inside of the cylinder, extending the period between servicing or the life of the cleaner roller. However, the openings can result in gaps in the cleaning surface of the roller, requiring multiple cleaning cycles to completely clean the surface of the fusing member by the tacky cleaner. Therefore in a continuous printing system toner particles on the fusing member can continue to disrupt fusing, or be transferred to subsequent documents, before their removal. An object of the present invention is to eliminate the need for multiple cleaning cycles with a tacky cleaner while maintaining or extending life and reliability.

Another cleaning assembly for a fusing member is described in copending U.S. patent Ser. No. 09/464,134, now U.S. Pat. No. 8,223,016, filed Dec. 16, 1999 and assigned to the same assignee as the present application i.e. Xerox Corporation.

It is known to employ a sticky cleaner roll in an electrophotographic printer and refresh it by routinely (i.e. once per several hundreds copies) transferring uniformly developed solid toner image out the cleaner roll surface. Disadvantages of this method is that it consumes a large amount of fresh toner, and this can be wasteful and costly. Toners used for electrophotographic systems tend to require costly pigments, additives, charge-control agents, severe size classification and other special property requirements to enable processes such as image development and transfer, and these requirements typically add high cost to the toner.

Another objective of this invention is to reduce the cost and wastefulness associated with tacky cleaning and refreshing approaches. In one embodiment of this invention, a less wasteful approach is preferably used where the waste toner from other cleaners that would otherwise be discarded in the electrophotographic system is used for the tacky cleaner refreshment. In another possible embodiment, the refreshing "toner" that is applied to the tacky cleaner member is lower cost material such as unclassified toner polymer particles or polymer layers rather than the toner used for the electrophotographic process. These less wasteful approaches can optionally be applied to any type of tacky cleaning system, such as existing perforated tube tacky cleaners, and these can be especially beneficial with the improved tacky cleaning systems described in this invention.

Other examples of cleaning systems employed in electrophotographic printers which relate to the technology described in this application are U.S. Pat. Nos. 3,649,992, 4,000,963, 4,013,400 and 4,607,947.

SUMMARY OF THE INVENTION

To achieve the advantages described herein in accordance with the purpose of the invention, the inventive features as embodied by the present invention include a method of refreshing a sticky cleaner member for a fusing system comprising the steps of: (I) precoating the cleaner member with a low cost polymer toner material prior to a printing operation; and (ii) removing contaminants from the sticky surface of the cleaner member.

In accordance with the features of the present invention lower cost raw polymer materials rather than higher cost toners are used in the electrophotographic system. Also the present invention employs a less wasteful approach by using the waste toner from other cleaning sub-systems such as photoreceptor cleaner in the electrophotographic system.

A refreshed cleaning member prior to being used to clean a fuser in an electrophotographic printer comprises a surface having substantially minimal contaminants thereon and a coating of a plastic toner material that can become tacky at the operating cleaner temperatures.

BRIEF DESCRIPTION OF THE DRAWINGS

The accompanying drawings, which are incorporated in and constitute a part of the specification illustrate embodiments of the invention and, together with the description, serve to explain the principles of the invention.

FIG. 2 is a view of a transfuser belt module employing a sticky cleaner system in accordance with the features of the present invention;

FIGS. 3A and 3B are cross sectional views of sticky cleaner rolls whose outer surfaces are being cleaned with a blade;

FIG. 4 is a cross sectional view of a sticky cleaner roll whose outer surface is being cleaned with a moving web;

FIG. 5 is a cross sectional view of a sticky cleaner roll whose outer surface is being cleaned by a grinding process; and FIG. 6 is a cross sectional view of a sticky cleaner roll whose outer surface is being cleaned by a perforated roll.

DETAILED DESCRIPTION OF THE PREFERRED EMBODIMENT

Figure 1:
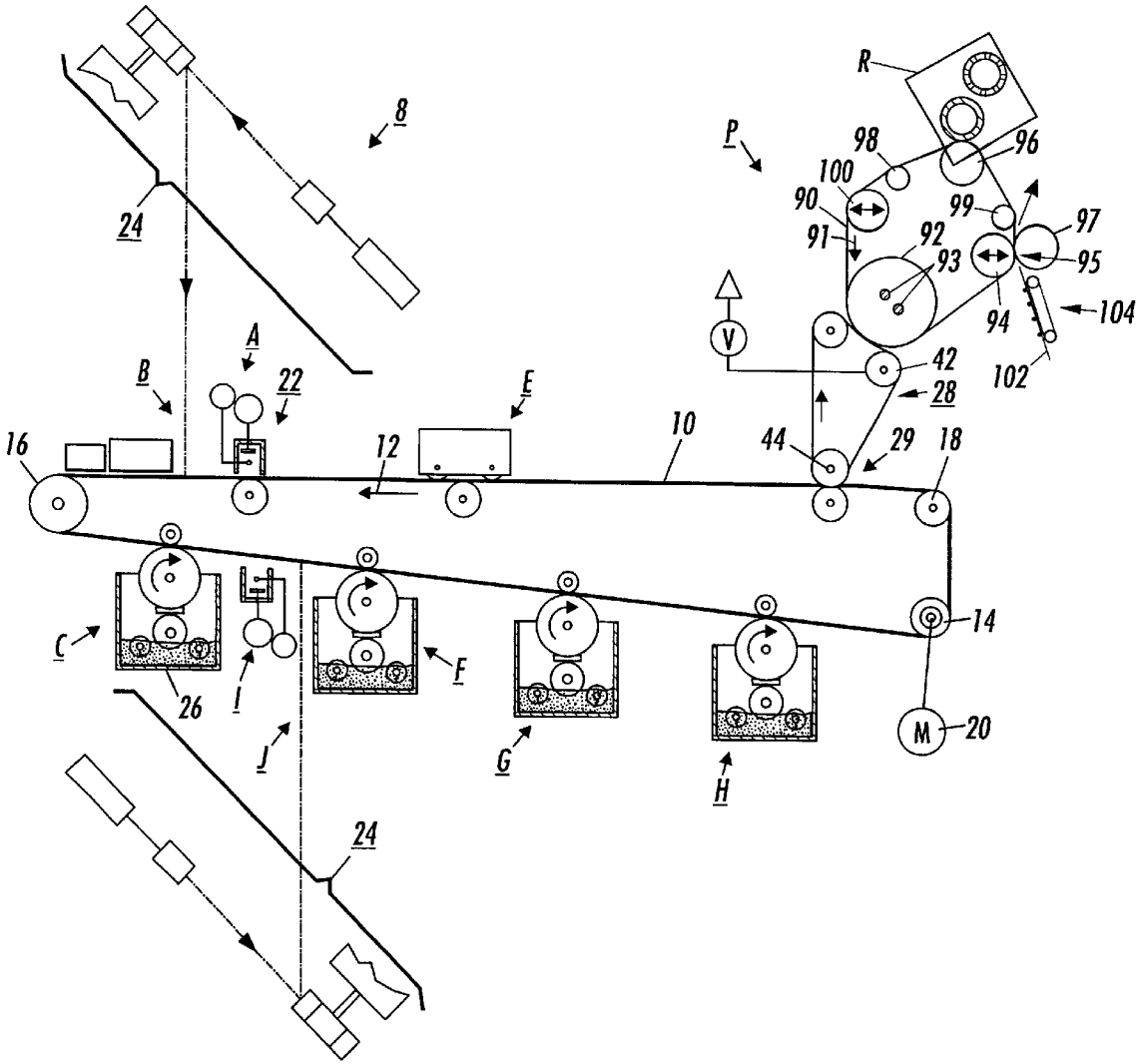
FIG. 1 is a partial schematic view of a printing apparatus that can employ the features of the present invention.

FIG. 1 illustrates an electrophotographic printing machine 8 that makes copies of original documents. Although the principles of the present invention are well suited for use in such electrophotographic copiers, they are also well suited for use in other printing devices, including electrophotographic printers. Therefore it should be understood that the present invention is not limited to the particular embodiment illustrated in FIG. 1 or to the particular application shown therein.

The printing machine 8 includes a charge retentive surface in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers (the rollers 16 and 18), and then rotating the drive roller 14 via a drive motor 20.

As the photoreceptor moves, each part of it passes through each of the subsequently described process stations. For convenience, a single section of the photoreceptor, referred to as the image area, is identified. The image area is that part of the photoreceptor which is operated on by the various process stations to produce a developed image. While the photoreceptor may have numerous image areas and since each image area is processed in the same way, a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about 500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

After passing through the charging station A the now charged image area passes to an exposure station B. At exposure station B the charged image area is exposed to the output of a laser based output scanning device 24 which illuminates the image area with a light representation of a first color image, say black. While FIG. 1 shows the exposure station as using laser light from an output scanning system, other optical projecting and exposure systems, such as an array of light emitting diodes, can also be used. That light representation discharges some parts of the image area so as to create an electrostatic latent image.

After passing through the exposure station B, the now exposed image area passes through a first development station C, which develops a first separation color image. The first development station C advances negatively charged development material 26, which is comprised of black toner particles, onto the image area. The development material is attracted to the less negative sections of the image area and repelled by the more negative sections. The result is a first toner image on the image area. The development material 26, and all of the subsequently described development materials, could be either powder or liquid, and the principles of the present invention apply to both powder and liquid development materials. If the development material is a powder toner then the toner image is substantially pure toner particles. However, if the development material is liquid the toner image is comprised of toner particles and a liquid carrier. Powder systems will be used in subsequent descriptions of what is referred to as an "Image on Image" color system.

After passing through the first development station C the image area advances to a second charging station "I", typically referred to as a "recharge" station, and an exposure station "J", which creates the latent charge image on the photoconductor needed for the next separation color toner. The previously developed, recharged and re-imaged photoconductor then moves to a development station F where the new toner color separation is deposited into the image region. The development system F for this process is chosen to have properties such that the previous color separation is not substantially disturbed during development of the additional color toner separation. The image region then advances through similar subsequent recharge, expose (not shown in FIG. 1), and development steps employing for example, development stations G and H to create a full color toner image on the photoconductor.

The image region with the full color toner image then advances to an intermediate transfer station 28 where the full color toner image is electrostatically transferred to the intermediate transfer belt using techniques well known in the art of electrostatic transfer. In FIG. 1, use of a positively biased transfer roller 44 is used for transfer of negative toner from the photoconductor to the intermediate belt.

The full color image then advances to the transfusing station P. That transfusing station includes means well known in the art to allow electrostatic transfer of the negative toner from the intermediate transfer belt to a transfuse belt. Negatively biased transfer roller 42 is shown for creation of the electrostatic field needed for electrostatic assisted transfer of the toner image to the transfuse member 90. The transfusing member 90 may be a belt, as illustrated in FIG. 1, or a drum. The transfusing system P is described herein below.

After the full color toner image is transferred to the intermediate belt 28 in the transfer nip 29, the image area passes to a cleaning station E. The cleaning station E removes any residual development material from the photoreceptor 10 that was not transferred in transfer nip 29, using a brush type cleaning member E.

After passing through the cleaning station E the image area repeats the charge-expose-develop-transfer sequence for creation of subsequent full color images.

The operation of the transfusing station P will now be described in detail. The transfusing member 90 is entrained between rollers 92, 94, 96, 98, 100. The transfuse member 90 is rotated by a motor, which is not shown, such that the transfusing member 90 rotates in the direction 91 in synchronism with the movement of the intermediate belt 28.

The transfusing assembly P also includes sources 93 for controlled heating of the roller 92, which then controllably heats the transfuse belt 90.

The heating of transfuse belt 90 causes the toner image layers on the transfuse belt 90 to reach the desired elevated temperature needed for transfusing of the toner to the final substrate in the pressure nip 95.

The transfusing station P also includes a backup roller 94 which rotates in the direction of 91. The backup roller cooperates with the roller 97 and with the transfusing member 90 to form a fusing zone. Marking substrate 102 is pre-heated prior to transfuse nip 95 by pre-heating station 104. When a marking substrate 102 passes through the fusing zone the heated composite toner image contacts the marking substrate as the marking substrate 102 passes between the roller 97 and the transfusing member 90. The combination of heat and pressure fuses the composite toner image onto the marking substrate. The marking substrate 102 with the color image then separates from the transfuse belt 90 with assistance from the roller 99. The remaining toner residual and any contaminants from the paper are then cleaned by the sticky cleaner system R, which will be described in detail below.

Details of the cleaning station R and methods of refreshing the cleaning member in such station will now be given.

In its simplest embodiment, the cleaning member 70 according to the features of the present invention consists of a carrier in the form of a roller, e.g., formed of aluminum or other metal, glass or plastic or cardboard, to which an approximately 0.01 to 6 mm thick layer of a polymer sticky at the operating temperature of the cleaner in the transfuse system. The operating temperature of the cleaner can be optionally controlled by internal and/or external heating and cooling means. The operating temperature of the sticky cleaner is chosen to be above the glass transition temperature of the polymer on the cleaner, and is chosen to cause the polymer material to be in the viscosity range typically between $10^3$ and $10^5$ Poise. More preferably, the temperature is chosen to cause a viscosity of the polymer to be in the range between $5\times10^3$ and $5\times10^4$ Poise. For typical polymer toner materials the temperature range will be between about 80 to 120° C. The temperature can be controlled to ranges if lower softening and melting polymers are used with the sticky cleaner. The sticky material is preferably a polymer, or mixture of polymers such as the toner polymer used in the xerographic printing system in the transfuse system.

The overall cleaning effect and particularly the life of the cleaning member according to the invention can be readily increased if the impurities, such as paper dust and toner material, are removed from the surface of the sticky layer, and the sticky layer is refreshed.

In accordance with the specific features of the present invention the cleaning member is precoated with a polymer material prior to performing a printing operation within the printing machine that contains the cleaning member. The polymer material used in the present invention can be any regular toner or toner-like polymer including resin or polymer, pigment and optionally a charge control agent, additive etc. A typical toner polymer used in electrophotographic machines has a glass transition temperature in the range of about 50° C. to about 70° C. The precoated thickness can vary but it has been found that precoating the cleaning member or cleaning roll with a layer of polymer material having a thickness in the range of about 0.01 mm to about 6 mm is preferable.

Resins can be used, such as for example, polymers or copolymers such as acrylates, such as poly(methyl methacrylate), styrenes, such as polystyrene, polyesters and polycarbonates, such as bisphenol A polycarbonate, a condensation polymer of terephthalic acid, ethylene glycol and 2,2'-bis-[4-(2-hydroxyethoxy)] propane, a polymer or copolymer of polysilane, polyamide, polyimide, mixtures thereof and copolymers thereof.

The toner compositions can include a polymer, and a colorant, such as a pigment, a dye, or mixtures thereof, and wherein the colorant is present in an amount of from about 1 to about 65 weight percent of the toner. A variety of colorants can be selected for use in the present invention. Pigments are preferred colorant materials because of there color values, color stability, and conductivity properties, and include, for example, carbon blacks, magnetites, cyan, yellow, magenta, red, green, blue, brown, orange, or mixtures thereof, and the like colors.

FIG. 2 specifically illustrates an embodiment of a sticky cleaner system that can incorporate the features of the present invention.

FIGS. 3A, 3B, 4, 5, and 6 illustrate different embodiments of sticky cleaner rolls whose outer surfaces are being cleaned so as to remove contaminants from these sticky surfaces. FIGS. 3A and 3B illustrate cleaning roll 70 moving in the direction of arrow 71 wherein contaminated toner is removed from the sticky surface thereof by a blade member 72 for refreshing of the stickiness of the surface of roll 70. The blade 72 is optionally continuously engaged. It can also be disengaged and periodically engaged to the cleaner roll 70. Preferably prior to engagement of blade 72, roll 70 is disengaged from the transfuse member 90 and the temperature of 70 is increased from a normal operating temperature to reduce the viscosity of the polymer layer to for example $10^3$ Poise or below in order to assist removal of the contaminated polymer layer. FIG. 4 illustrates a web 73 supplied from web supply roll 74 and taken up by web take-up roll 75, the web traveling in direction of arrow 76. The web can optionally be impregnated with a small amount of silicone oil. As cleaning roll 70 moves in the direction of arrow 71 the web 73 which is forcefully positioned against cleaning roll 70 by roller 77 which moves against roll 70 in the direction of arrow 78. Web 73 cleans the surface of sticky roll 70 due to the forcible contact of web 73 against roll 70 as roll 70 rotates. The web 73 is optionally continuously engaged. It can also be disengaged and periodically engaged to the cleaner roll 70. FIG. 5 illustrates a cleaning roll 70 moving in the direction of arrow 71 including a grinding member 79 positioned to rotate against roll 70 to thereby grind contaminated toner off of roll 70. The grinding member 79 is optionally continuously engaged. It can also be disengaged and periodically engaged to the cleaner roll 70. Further, it can optionally be engaged for refreshing only during startup or warmup of the system while the cleaner member is in a substantially cooled state. Still another embodiment illustrated in FIG. 6. As shown, a sticky roll 70 moves in the direction of arrow 71. At the same time a perforated roller 81 is pushed in the direction of arrow 82 so as to be in a forced position against roll 70. Prior to engagement of roller 81, preferably roll 70 is disengaged from the transfuse member and the tempeature of 70 is increased from a normal operating temperature to reduce the viscosity of the polyment layer to for example $10^3$ Poise or below in order to assist removal of the contaminated polymer layer. As such, the perforated roll 81 will remove contaminated toner from the sticky surface of roll 70. For all the above embodiments, means such as a catch tray (not shown) can be used for collecting the removed contaminated material.

The refreshing process in accordance with the features of the present invention can be performed every time the electrophotographic printer is cycled-up, cycled-down, or at any fixed printing interval. The refreshing process could also happen on a more frequent basis depending on the specific refreshing needs. Additional fresh toner or plastic could be applied to the cleaner when the uncontaminated coating reservoir becomes low. The proposed concept not only provides a means of refreshing the sticky cleaner, but it could also substantially increase the life of the sticky cleaner.

The sticky cleaning embodiments described in this invention are not restricted to the details of the imaging system and transfuse system described. For example, the color image can be built up by creating and developing the 4 color separations on 4 separate photoconductor drums or belts and then transferring and accumulating the registered separation toner images on an intermediate belt to create a full color image on the intermediate belt for transfer to the transfuse belt.

Alternatively, color images can be directly transferred from photoconductor imaging systems to the transfuse belt without use of an intermediate belt. The sticky cleaning embodiments are also not restricted to transfuse systems and can be used with conventional fuser systems that for example electrostatically transfer the toner image to a media from a photoconductor and then subsequently transport the media to a fusing system. Finally, the embodiments are not restricted to full color systems and can be favorably applied to monochrome or spot color systems as well. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method of refreshing a sticky cleaner member used for cleaning a transfuse member or a fuser member in an electrophotographic printer comprising the steps of:

(i) precoating the cleaner member with spent waste toner material prior to a printing operation; and (ii) removing contaminants from the sticky surface of the cleaner member.

2. A method according to claim 1 wherein a roller is employed for cleaning the transfuse member.

3. A method according to claim 1 wherein said toner coating has a thickness of from about 0.01 mm to about 6 mm.

4. A method according to claim 1 wherein said contaminants are removed from said sticky surface by a blade member.

5. A method according to claim 4 wherein the cleaner member is disengaged from the transfuse member or fuser member and a temperature of the cleaner member is increased above a normal operating temperature to assist in removal of contaminants.

6. A method according to claim 1 wherein said contaminants are removed from said sticky surface by a moving web member.

7. A method according to claim 1 wherein said contaminants are removed from said sticky surface by a grinding process.

8. A method according to claim 7 wherein the cleaner member is disengaged from the transfuse or fuser member and the temperature of the cleaner member is increased above a normal operating temperature to assist in removal of contaminants.

9. A method according to claim 1 wherein said contaminants are removed from said sticky surface by a moving perforated roller.

10. A method according to claim 9 wherein the cleaner member is disengaged from the transfuse or fuser member and the temperature of the cleaner member is increased above a normal operating temperature to assist in removal of contaminants.

11. A method according to claim 1 wherein said toner material is obtained from waste toner from other cleaning systems.

12. A method according to claim 1 wherein said sticky surface is formed of a polymer toner or a mixture of polymer toners.

13. A method according to claim 1 wherein a plastic toner material is coated over said polymer surface.

14. A method according to claim 13 wherein said plastic toner material is obtained from waste toner from other cleaning systems.

15. A method of refreshing a sticky cleaner member used for cleaning a transfuse member or a fuser member in an electrophotographic printer comprising the steps of:

(i) precoating said cleaner member with waste toner from other cleaning systems (ii) refreshing the sticky cleaner member, after contamination due to at least one printing operation, with a waste toner layer which covers a contaminated toner layer.

16. A method according to claim 15 wherein if waste toner is not available in sufficient quantity to refresh said sticky cleaner member then fresh toner or other polymer is employed to cover a contaminated toner layer.

* * * * *